United States Patent [19]

Mehta et al.

[11] Patent Number: 4,543,317

[45] Date of Patent: Sep. 24, 1985

[54] PHOTOGRAPHIC SYSTEM WITH SALT OF PHENYLMERCAPTOAZOLE AND QUATERNARY RADICAL

[75] Inventors: Avinash C. Mehta, Belmont; Lloyd D. Taylor, Lexington, both of Mass.

[73] Assignee: Polaroid Corporation, Cambridge, Mass.

[21] Appl. No.: 683,396

[22] Filed: Dec. 19, 1984

[51] Int. Cl.[4] ..... G03C 1/40; G03C 5/54; G03C 5/38

[52] U.S. Cl. ..... 430/219; 430/218; 430/239; 430/428; 430/566; 430/611; 430/955; 430/957

[58] Field of Search ..... 430/218, 219, 428, 251, 430/566, 611, 955, 957, 960, 239

[56] References Cited

U.S. PATENT DOCUMENTS

| | | | |
|---|---|---|---|
| 3,173,786 | 3/1965 | Green et al. | 430/218 |
| 3,816,125 | 6/1974 | Demember et al. | 430/218 |
| 4,328,302 | 5/1982 | Nishimura et al. | 430/264 |
| 4,390,613 | 6/1983 | Mehta et al. | 430/219 |

*Primary Examiner*—Richard L. Schilling
*Attorney, Agent, or Firm*—Gaetano D. Maccarone

[57] ABSTRACT

There is described a photographic system wherein development of an exposed photosensitive element with an aqueous alkaline processing composition is effected in the presence of a compound which is a salt of a radical of a substituted phenylmercaptoazole complexed with a radical of a quaternary. The salts are either insoluble or have extremely low solubility in water and become soluble, and photographically active, in alkaline environment.

20 Claims, 1 Drawing Figure

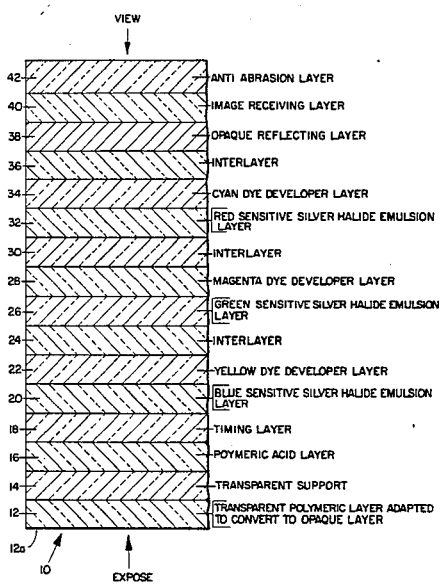

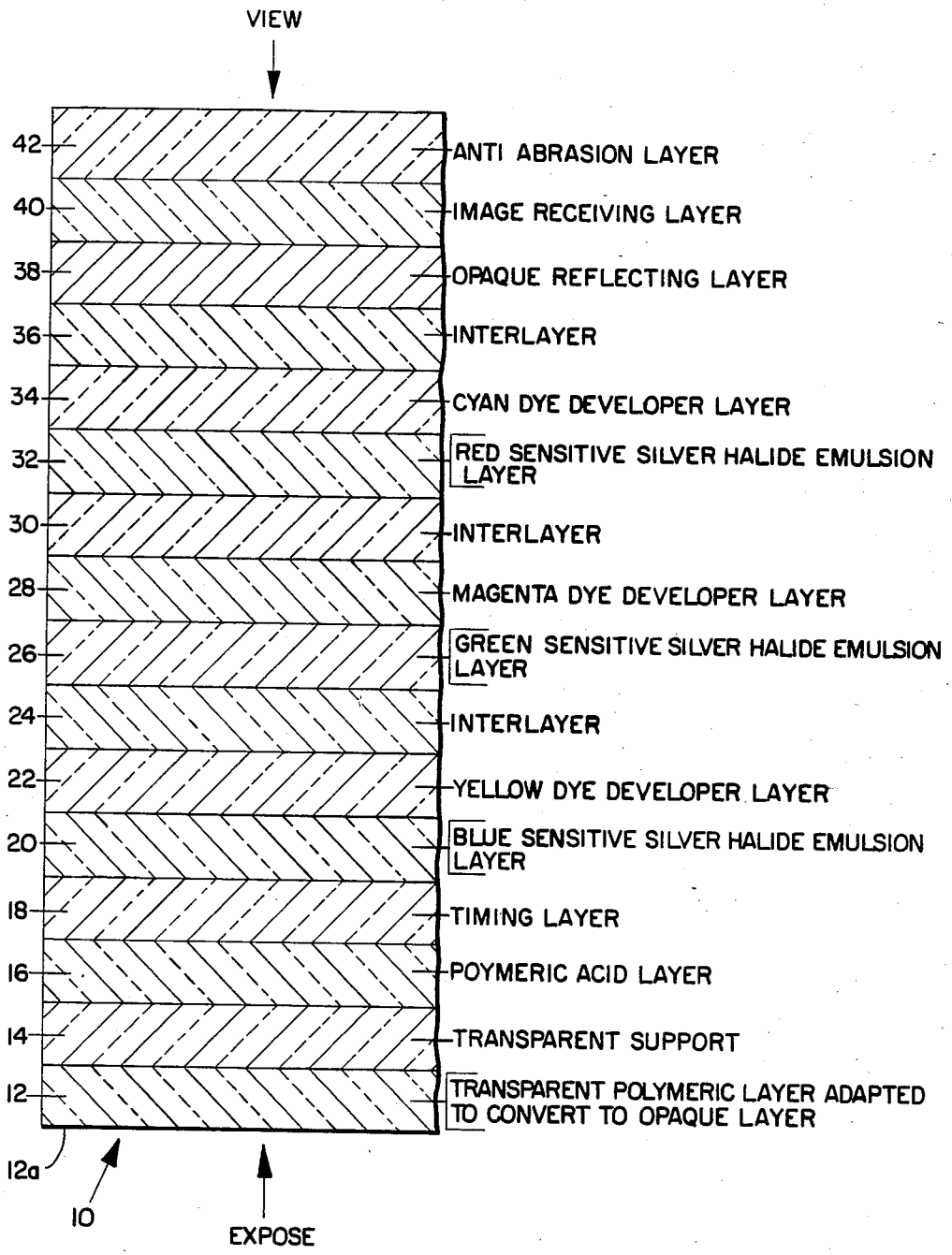
VIEW
42
ANTI ABRASION LAYER
40
IMAGE RECEIVING LAYER
38
OPAQUE REFLECTING LAYER
36
INTERLAYER
34
CYAN DYE DEVELOPER LAYER
32
RED SENSITIVE SILVER HALIDE EMULSION LAYER
30
INTERLAYER
28
MAGENTA DYE DEVELOPER LAYER
26
GREEN SENSITIVE SILVER HALIDE EMULSION LAYER
24
INTERLAYER
22
YELLOW DYE DEVELOPER LAYER
20
BLUE SENSITIVE SILVER HALIDE EMULSION LAYER
18
TIMING LAYER
16
POYMERIC ACID LAYER
14
TRANSPARENT SUPPORT
12
TRANSPARENT POLYMERIC LAYER ADAPTED TO CONVERT TO OPAQUE LAYER
12a
10
EXPOSE

PHOTOGRAPHIC SYSTEM WITH SALT OF PHENYLMERCAPTOAZOLE AND QUATERNARY RADICAL

BACKGROUND OF THE INVENTION

The application relates to a photographic system wherein a radical of a substituted phenylmercaptoazole and a radical of a quaternary are released during development of an exposed photosensitive element.

In various photographic systems for forming images, whether in black or white or in color, it is often desirable to include in a photographic film unit one or more of the various photographic reagents required for development and/or to enhance image quality. This practice extends both to conventional systems for forming negative images and also to various systems such as diffusion transfer wherein a positive image in silver or in color is obtained. In many instances, the photographic reagent may be contained initially in either the processing composition applied for development and image formation or in the film unit itself. The latter is typically preferred so as to reduce the number of ingredients required in the processing composition. In other instances, the particular photographic reagent desired is not sufficiently stable in alkali to provide the requisite shelf life for the processing composition or the reagent is incompatible and/or reacts with another reagent in the processing composition and therefore must be contained initially in the film unit. In still other instances, the reagent must be provided at some particular time in the development process which requires that it be present in a specified layer or in specified proximity to another layer in the film unit.

In all of the foregoing instances, it is desirable that the reagent be contained in the desired layer or layers of the film unit in a form that is stable and non-migratory or non-diffusible and yet available when it is required at a particular time in the development process. To accomplish this result, it is known in the art to attach to the particular photographic reagent a blocking moiety which prevents the photographic reagent from reacting with other photographic materials present in the film unit or migrating or diffusing prior to the time when photographic development is effected but which will release the photographic reagent at the desired time such as by reaction with the aqueous alkaline processing composition.

It is known in the art to use blocked development restrainers which are designed to provide a timed release of a development restrainer during the development process. See, for example, U.S. Pat. No. 3,698,898 which discloses the use of quinone-or naphthoquinone-methide precursors which release a photographic reagent such as phenylmercaptotetrazole in the presence of alkali. It is also known in the photographic art to utilize blocked compounds which provide a timed release of substituted phenylmercaptoazoles in the presence of alkali. See, for example, U.S. Pat. Nos. 4,355,092, 4,355,101 and 4,390,613.

The present application relates to photographic products and processes which utilize compounds which release two photographically useful reagents in the presence of alkali.

SUMMARY OF THE INVENTION

It is therefore an object of this invention to provide a novel photographic system.

It is another object to provide a photographic system wherein development of an exposed photosensitive element is effected in the presence of a compound which provides controlled release of two photographically useful reagents.

Still another object is to provide a photographic system wherein development of an exposed photosensitive element is carried out in conjunction with the controlled release of a radical of a substituted phenylmercaptoazole and a radical of a quaternary.

Another object is to provide photographic products and processes utilizing such compounds.

Yet another object is to provide diffusion transfer photographic products and processes utiizing such compounds.

BRIEF SUMMARY OF THE INVENTION

These and other objects and advantages are accomplished in accordance with the invention by providing a photographic system wherein development of an exposed photosensitive element with an aqueous alkaline processing composition is effected in the presence of a compound represented by the formula

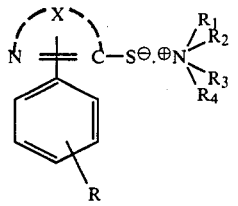

wherein X represents the nonmetallic atoms necessary to form a nucleus which completes a 5 or 6 member heterocyclic moiety including substituted rings and fused rings; R may be either any suitable substituent which has a pKa of from about 7 to about 14 which is ionizable to an anion whereby the silver salt of the mercaptan moiety (resulting from dissociation in alkali) is rendered more soluble in the pH range within which R is ionized to anion that it is below that pH range, or a precursor of such a substituent which is capable of being converted to such a substituent upon contact with an aqueous alkaline medium. Suitable groups include, for example, —OH;

$$-\overset{O}{\overset{\|}{C}}-CH_3;\ -O-\overset{O}{\overset{\|}{C}}-CH_3;$$

$$-SO_2NH_2;\ -SO_2NHCH_3;\ -SO_2NHC_8H_{17};$$

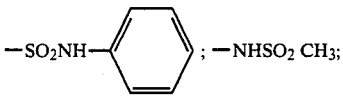

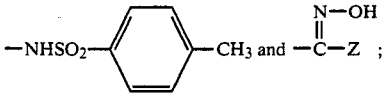

Z is H, alkyl having from 1 to 10 carbon atoms; aralkyl such as benzyl or phenethyl, or aryl such as phenyl or phenyl substituted with substituents such as halogen, alkoxy or alkyl; and $R_1$, $R_2$, $R_3$ and $R_4$ can independently be alkyl having from 1 to 6 carbon atoms; or $R_1$ can be $(CH_2)_n$—$R_5$ and $R_2$, $R_3$ and $R_4$, together with the nitrogen atom, form a substituted or unsubstituted six member heterocyclic ring; $R_5$ can be hydrogen, phenyl or phenyl substituted with substituents such as alkoxy, alkyl or halogen; and n is an integer of from 1 to 6.

U.S. Pat. No. 3,173,786 discloses that quaternary groups can function as development accelerators in diffusion transfer photographic systems which utilize dye developers as the image dye-providing materials. It is also disclosed that, in such systems, quaternary groups which include a reactive methyl group, i.e., a methyl group which in alkali is capable of forming a methylene base, can also provide improved color separation, i.e., the transfer of the dye developers is more closely controlled by the silver halide emulsion with which each is associated. Thus, in the embodiment wherein $R_1$ is —$(CH_2)_n$—$R_5$ and $R_2$, $R_3$ and $R_4$, together with the nitrogen atom, form a six member heterocyclic ring, it is preferred to have a methyl substituent in the 2-position on the ring and it is further preferred to have $R_5$ represent a phenyl group and n represent an integer of from 1 to 4.

In a particularly preferred embodiment X represents the nonmetallic atoms necessary to complete a tetrazole moiety; $R_1$ is

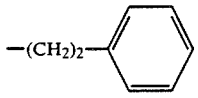

and $R_2$, $R_3$ and $R_4$, together with the nitrogen atom, form a pyridine ring having a methyl substituent in the 2-position.

The phenylmercaptoazole moiety may have the substituted phenyl ring attached to either a nitrogen atom or a carbon atom. The heterocyclic moieties formed by X preferably are those wherein the heterocyclic atoms (i.e., atoms other than carbon) are members of a single heterocyclic ring as contrasted with compounds containing fused or condensed heterocyclic rings in which the heterocyclic atoms are members of more than one heterocyclic ring. The phenylmercaptoazole moiety includes radicals of monoazoles such as benzoxazoles, benzothiazoles and the like; diazoles such as benzimidazoles and the like; triazoles such as 1, 2, 4-triazoles and the like; tetrazoles and pyrimidines.

The compounds of the invention are either insoluble, or have extremely low solubility, in water. Thus, when incorporated into photographic elements as will be described in detail hereinafter, the salts may be coated from aqueous solution. The salts become soluble in the alkaline environment present during photographic processing, i.e., at a pH of from about 7 to about 14, and the complex separates into two photographically useful moieties. Of course, it will be appreciated by those skilled in the art that the dissociation of the complex will be dependent upon the pH of the alkaline medium. Thus, the pH of the aqueous alkaline medium used during photographic processing should be such as to cause dissociation of the complex. It is preferred to utilize an aqueous alkaline medium having a relatively high pH, i.e., from about 10 to about 14. The quaternary moiety acts as a development accelerator and assists in the color isolation or separation, of the transfer images. The azole moiety, as will be described in detail below, is thought to provide dual functions which are pH dependent, namely as a weak silver solvent and promoter of development at a pH above the pKa of R and as a development restrainer at a pH below the pKa of R. Accordingly, there is provided a controlled release of the quaternary radical and the substituted phenylmercaptoazole radical.

DESCRIPTION OF THE PREFERRED EMBODIMENTS

Particularly preferred compounds according to the invention are represented by the formulas (I)

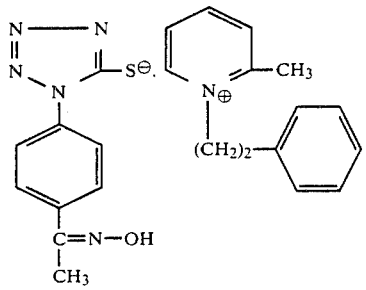

(II)

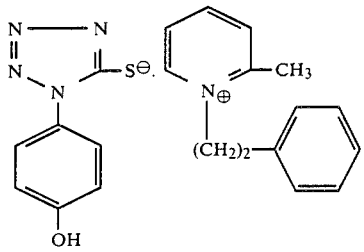

(III)

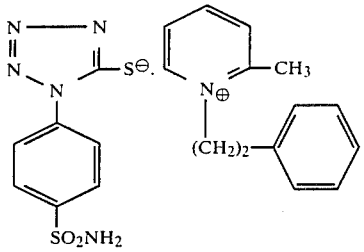

(IV)

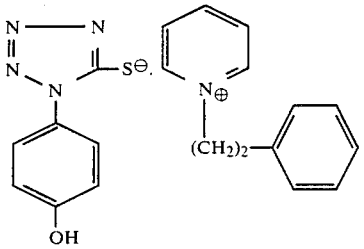

The compounds of the invention can be made by reactions which are known in the art and these will be apparent to those skilled in the art particularly in view of the disclosure provided herein. Generally, the appropriate substituted phenylmercaptoazole can be reacted with an appropriate base, such as sodium bicarbonate, in water to form the sodium salt thereof and subsequently the sodium salt can be reacted with the appropriate quaternary to form the desired product. The starting materials can be made by reactions which are known to those of ordinary skill in the art. For example, 2-mercaptoimidazoles can be prepared by the reactions disclosed in the Chemistry of Heterocyclic Compounds Vol. 6: Imidazole and Its Derivatives, Part I, Hoffman, Interscience Publishers, Inc., New York, 1953, pages 77–85; hydroxyalkylimidazoles, ibid, pages 99–104; chloroalkylimidazoles, ibid, page 121; mercaptothiazoles and mercaptobenzothiazoles can be prepared according to the methods disclosed in The Chemistry of Heterocyclic Compounds Vol. 34: Thiazole and Its Derivatives, Part I, Metzger, John Wiley and Sons, 1979, pages 260–269; Part 2, pages 370–377; benzoxazolethiazones can be prepared according to the methods disclosed in Heterocyclic Compounds, Vol. 5, Elderfield, John Wiley and Sons, 1957, pages 439–444; 5-mercapto-1,3,4-oxadiazoles can be prepared according to the methods disclosed in Heterocyclic Compounds, Vol. 7, Elderfield, John Wiley and Sons, 1961, page 352; mercapto-1,3,4 thiadiazoles, ibid, pages 587–612; and tetrazoles by the techniques disclosed in Heterocyclic Compounds, Vol. 8, Elderfield, John Wiley and Sons, 1967, pages 1–107. Mercapto-1,2,4-triazoles can be prepared by known literature techniques as described, for example, in J. Chem. Soc. E. Hoggarth 1163 (1949).

The salts may be present in photographic elements in any appropriate location and in any amount which is required to accomplish their intended purpose. The amount necessary in any particular instance is dependent upon a number of factors such as, for example, the compound utilized, the type of photographic element and the result desired. Routine scoping tests may be used to ascertain the concentration appropriate for any given photographic element. In a preferred embodiment of the invention the compounds are incorporated in diffusion transfer photographic film units as will be discussed in more detail below herein. In such film units the compounds may be incorporated in the photosensitive element and/or the image-receiving element or in a cover sheet.

The salts of the invention may be utilized in any photographic system wherein the release of a quaternary and a development restrainer during development of an exposed photosensitive element is desired, including photographic systems for forming images in black and white or in color and those wherein the final image is a silver image or one formed by other image-forming materials. Further, where appropriate, the salts may be utilized in various layers of a multilayer photographic system in varying concentrations to ensure the desired distribution of the photographic reagents during processing.

While not wishing to be bound by any proposed theoretical mechanism, the advantageous results which are obtainable by the release of the substituted phenylmercaptoazole moiety during processing of a diffusion transfer film unit are thought to be due to that moiety performing different functions at different stages of the development process, that is, as weak silver solvents and promoters of development at one stage of the development process and as development restrainers, or inhibitors, at another stage of the process and that the dual functions of such moieties within the diffusion transfer system are pH dependent.

It is well known that in the diffusion transfer development process the pH of any particular location within the film unit varies with time. Typically, the processing composition employed in the process has a very high pH, e.g., from about 13–14 and during the development process each layer of the multilayer film unit goes through a broad pH range which includes very high pH levels and relatively low pH levels. When the pH is substantially equal to or above the pKa of the substituent R on the phenyl ring, the dianion is formed, for example,

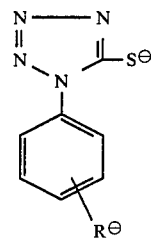

and acts as a weak silver solvent to form relatively soluble silver salts, thus promoting development. When the pH falls below the pKa of the substituent R, the monoanion is formed, for example

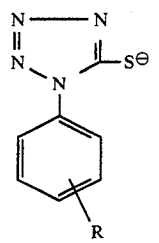

and the silver salt of the monanion of the compound is very low in solubility resulting in a development restrainer action.

In view of the foregoing and the requirement that the pH of the alkaline medium be such as to cause dissociation of the complex, when it is desired to utilize both functions of the phenylmercaptoazole moiety development of the exposed photosensitive element in the presence of such salts is carried out with a processing composition having a pH which is sufficient to cause dissociation and which is substantially equal to or above the pKa of the particular substituent, at least for some period of time, when the processing composition comes into contact with the complex so as to cause the complex to dissociate and to enable the substituent (R) to ionize to form the dianion. In addition, at some point during the development process, the pH of the environment where the compound is located will go below the pKa of the substituent so as to enable th monoanion to be formed again.

The compound utilized according to the invention may be used in conjunction with any photographic emulsion. In a preferred embodiment the compounds are utilized in diffusion transfer photographic systems, particularly those which include a negative working silver halide emulsion, i.e., one which develops in the areas of exposure. Further, those compounds may be used in association with any image dye-providing materials. In a particularly preferred embodiment the diffusion transfer photographic film elements of the invention include one or more image dye-providing materials which may be initially diffusible or nondiffusible. In diffusion transfer photographic systems the image dye-providing materials which can be utiized generally may be characterized as either (1) initially soluble or diffusible in the processing composition but which are selectively rendered nondiffusible imagewise as a function of development; or (2) initially insoluble or nondiffusible in the processing composition but which selectively provide a diffusible product imagewise as a function of development. The image dye-providing materials may be complete dyes or dye intermediates, e.g., color couplers. The requisite differential in mobility or solubility may be obtained, for example, by a chemical reaction such as a redox reaction, a coupling reaction or a cleavage reaction. In a particularly preferred embodiment of the invention the image dye-providing materials are dye developers which are initially diffusible materials. The dye developers contain, in the same molecule, both the chromophoric system of a dye and a silver halide developing function as is described in U.S. Pat. No. 2,983,606. Other image dye-providing materials which may be used include, for example, initially diffusible coupling dyes such as are useful in the diffusion transfer process described in U.S. Pat. No. 3,087,817 which are rendered nondiffusible by coupling with the oxidation product of a color developer; initially nondiffusible dyes which release a diffusible dye following oxidation, sometimes referred to as "redox dye releaser" dyes, described in U.S. Pat. Nos. 3,725,062 and 4,076,529; initially nondiffusible image dye-providing materials which release a diffusible dye following oxidation and intramolecular ring closure as are described in U.S. Pat. No. 3,433,939 or those which undergo silver assisted cleavage to release a diffusible dye in accordance with the disclosure of U.S. Pat. No. 3,719,489; and initially nondiffusible image dye-providing materials which release a diffusible dye following coupling with an oxidized color developer as described in U.S. Pat. No. 3,227,550. The effect obtained upon any individual image dye-providing material will be dependent, at least in part, upon the distance between the compound and the image dye-providing material in the film unit.

The compounds may be incorporated into the photographic elements by any suitable technique. The compounds can be incorporated in the photographic element typically by being coated from a water dispersion and the layer(s) in which they reside typically include a binder material such as gelatin or the like.

In a preferred embodiment of the invention, the compounds are utilized in diffusion transfer photographic film units in conjunction with initially diffusible dye developers as the image dye-providing materials. As described in U.S. Pat. No. 2,983,606 a photosensitive element containing a dye developer and a silver halide emulsion is photoexposed and a processing composition applied thereto, for example, by immersion, coating, spraying, flowing, etc., in the dark. The exposed photosensitive element is superposed prior to, during, or after the processing composition is applied, on a sheet-like support element which may be utilized as an image-receiving element. In a preferred embodiment, the processing composition is applied to the exposed photosensitive element in a substantially uniform layer as the photosensitive element is brought into superposed relationship with the image-receiving layer. The processing composition, positioned intermediate the photosensitive element and the image-receiving layer, permeates the emulsion to initiate development. The dye developer is immobilized or precipitated in exposed areas as a consequence of the development. In unexposed and partially exposed areas of the emulsion, the dye developer is unreacted and diffusible and thus provides an imagewise distribution of unoxidized dye developer, diffusible in the processing composition, as a function of the point-to-point degree of exposure of the silver halide emulsion. At least part of this imagewise distribution of unoxidized dye developer is transferred, by imbibition, to a superposed image-receiving layer or element, said transfer substantially excluding oxidized dye developer. The image-receiving layer receives a depthwise diffusion, from the developed emulsion, of unoxidized dye developer without appreciably disturbing the imagewise distribution thereof to provide a reversed or positive color image of the developed image. The image-receiving element may contain agents adapted to mordant or otherwise fix the diffused, unoxidized dye developer. In a preferred embodiment of said U.S. Pat. No. 2,983,606 and in certain commercial applications thereof, the desired positive image is revealed by separating the image-receiving layer from the photosensitive element at the end of a suitable imbibition period. Alternatively, as also disclosed in said U.S. Pat. No. 2,983,606, the image-receiving layer need not be separated from its superposed contact with the photosensitive element, subsequent to transfer image formation, if the support for the image-receiving layer, as well as any other layers intermediate said support and image-receiving layer, is transparent and a processing composition containing a substance, e.g., a white pigment, effective a mask the developed silver halide emulsion or emulsions is applied between the image-receiving layer and said halide emulsion or emulsions.

Dye developers, as noted in said U.S. Pat. No. 2,983,606, are compounds which contain, in the same molecule, both the chromophoric system of a dye and also a silver halide developing function. By "a silver halide developing function" is meant a grouping adapted to develop exposed silver halide. A preferred silver halide development function is a hydroquinonyl group. In general, the development function includes a benzenoid developing function, that is, an aromatic developing group which forms quinonoid or quinone substances when oxidized.

Multicolor images may be obtained using dye developers in diffusion transfer processes by several techniques. One such technique contemplates obtaining multicolor transfer images utilizing dye developers by employment of an integral multilayer photosensitive element, such as is disclosed in the aforementioned U.S. Pat. No. 2,983,606 and in U.S. Pat. No. 3,345,163, wherein at least two selectively sensitized photosensitive strata, superposed on a single support, are processed, simultaneously and without separation, with a single common image-receiving layer. A suitable arrangement of this type comprises a support carrying a red-sensitive silver halide emulsion stratum, a green-sensitive silver halide emulsion stratum and a blue-sensitive silver halide emulsion stratum, said emulsions having associated therewith, respectively, for example, a cyan dye developer, a magenta dye developer and a yellow dye developer. The dye developer may be utilized in the silver halide emulsion stratum, for example, in the form of particles, or it may be disposed in a stratum behind the appropriate silver halide emulsion strata. Each set of silver halide emulsion and associated dye developer strata may be separated from other sets by suitable interlayers, for example, by a layer or stratum of gelatin or polyvinyl alcohol. In certain instances, it may be desirable to incorporate a yellow filter in front of the green-sensitive emulsion and such yellow filter may be incorporated in an interlayer. However, where desirable, a yellow dye developer of the appropriate spectral characteristics and present in a state capable of functioning as a yellow filter may be so employed and a separate yellow filter omitted.

Particularly useful products for obtaining multicolor dye developer images are disclosed in U.S. Pat. No. 3,415,644. This patent discloses photographic products wherein a photosensitive element and an image-receiving are maintained in fixed relationship prior to exposure, and this relationship is maintained as a laminate after processing and image formation. In these products, the final image is viewed through a transparent (support) element against a light-reflecting, i.e., white background. Photoexposure is made through said transparent element and application of the processing composition provides a layer of light-reflecting material to provide a white background. The light-reflecting material (referred to in said patent as an "opacifying agent") is preferably titanium dioxide, and it also performs an opacifying function, i.e., it is effective to mask the developed silver halide emulsions so that the transfer image may be viewed without interference therefrom, and it also acts to protect the photoexposed silver halide emulsions from post-exposure fogging by light passing through said transparent layer if the photoexposed film unit is removed from the camera before image formation is completed.

U.S. Pat. No. 3,647,437 is concerned with improvements in products and processes disclosed in said U.S. Pat. No. 3,415,644, and discloses the provision of light-absorbing materials to permit such processes to be performed, outside of the camera in which photoexposure is effected, under much more intense ambient light conditions. A light-absorbing material or reagent, preferably a pH-sensitive phthalein dye, is provided so positioned and/or constituted as not to interfere with photoexposure but so positioned between the photoexposed silver halide emulsions and the transparent support during processing after photoexposure as to absorb light which otherwise might fog the photoexposed emulsions. Furthermore, the light-absorbing material is so positioned and/or constituted after processing as not to interfere with viewing the desired image shortly after said image has been formed. In the preferred embodiments, the light-absorbing material, also sometimes referred to as an optical filter agent, is initially contained in the processing composition together with a light-reflecting material, e.g., titanium dioxide. The concentration of the light-absorbing dye is selected to provide the light transmission opacity required to perform the particular process under the selected light conditions.

In a particularly useful embodiment, the light-absorbing dye is highly colored at the pH of the processing composition, e.g., 13–14, but is substantially non-absorbing of visible light at a lower pH, e.g., less than 10–12. This pH reduction may be effected by an acid-reacting reagent appropriately positioned in the film unit, e.g., in a layer between the transparent support and the image-receiving layer.

The dye developers are preferably selected for their ability to provide colors that are useful in carrying out subtractive color photography, that is, the previously mentioned cyan, magenta and yellow. The dye developers employed may be incorporated in the respective silver halide emulsion or, in the preferred embodiment, in a separate layer behind the respective silver halide emulsion, and such a layer of dye developer may be applied by use of a coating solution containing the respective dye developer distributed, in a concentration calculated to give the desired coverage of dye developer per unit area, in a film-forming natural, or synthetic, polymer, for example, gelatin, polyvinyl alcohol, and the like, adapted to be permeated by the processing composition.

Other diffusion transfer products and processes in which the dye developers of the present invention may be utilized are described in U.S. Pat. Nos. 3,573,043 and 3,594,165. For convenience, the entire disclosure of each of the six patents referred to immediately above is hereby incorporated by reference herein.

A particularly useful film unit according to the invention is one wherein the photosensitive element includes a light-reflecting layer between the silver halide layer and the image dye-providing material layer (as described in Canadian Pat. No. 668,592), the substrate of the photosensitive element carries the polymeric acid neutralizing layer which in turn carries the timing layer (as described in U.S. Pat. No. 3,573,043) and the processing composition includes an oximated polydiacetone acrylamide thickening agent (as described in U.S. Pat. No. 4,202,694).

In a preferred diffusion transfer film unit according to the invention the compound is incorporated in the photosensitive element in a layer between the support of the element and the silver halide emulsion closest to that support. This structure combines a delay in the release of the two groups with a delay in the diffusion thereof through the film unit.

In the FIGURE there is shown another preferred diffusion transfer film unit of the invention wherein the film unit 10 comprises a transparent support 14 carrying on a first side thereof a layer 12 of a transparent polymeric material adapted to convert to an opaque condition when contacted by an aqueous alkaline processing composition. On the opposite side of support layer 14 is shown a polymeric acid-reacting layer 16, timing layer 18, a blue sensitive silver halide emulsion layer 20, a yellow dye developer layer 22, an interlayer 24, a green sensitive silver halide emulsion layer 26, a magenta dye developer layer 28, an interlayer 30, a red sensitive silver halide emulsion layer 32, a cyan dye developer layer 34, an interlayer 36, an opaque/reflective layer 38 (which preferably contains a white pigment such as titanium dioxide to provide a white background against which the image is viewed and an opacification agent such as carbon black), an image receiving layer 40 and an anti-abrasion layer 42 which may comprise sodium cellulose sulfate.

Photoexposure of the silver halide emulsion layers is effected through the transparent polymeric layer 12 and through transparent support 14 and the layer carried thereon, i.e., the polymeric acid layer 16 and the spacer or timing layer 18, which layers are also transparent, the film unit being so positioned within the camera that light admitted through the camera exposure or lens system is incident upon the outer or exposure surface 12*a* of the polymeric layer 12.

After photoexposure, the film unit is developed such as by immersing it in an aqueous alkaline processing composition. After a suitable imbibition period, e.g., in the range of about 40 to 120 seconds, the transparent polymeric layer 12 is converted by the alkaline processing composition to a highly colored, or opaque, layer. In addition, development of emulsion layers 20, 26 and 32 is initiated by contact with the processing composition. If the film unit is removed from the processing composition to conditions of ambient light, the still photosensitive and developing emulsion layers thereof are protected against additional photoexposure by ambient of environmental light through transparent support 14 by the now opaque layer 12. The emulsion layers are protected against additional photo-exposure from the opposed, or image-viewing, side of the film unit by opaque reflective layer 38.

In exposed and developed areas, the dye developers are oxidized as a function of the silver halide development and are immobilized. Unoxidized dye developer associated with undeveloped and partially developed areas remain mobile and is transferred to the image receiving layer 40 to provide the desired positive image therein. Permeation of the alkaline processing composition through the several layers of the film unit is controlled so that the process pH is maintained at a high enough level to effect the requisite development and image transfer and to convert polymeric layer 12 to a highly colored form after which pH reduction is effected as a result of alkali permeation into the polymeric acid layer 16 such that the pH is reduced to a level which stops further dye transfer. Layer 12, after having been rendered opaque by the action of alkali, remains opaque notwithstanding this pH reduction. The image present in image receiving layer 40 is viewed through the anti-abrasion layer 42 against the reflecting layer 38 which provides an essential white background for the dye image and also effectively masks from view the developed silver halide emulsion layers and dye developer immobilized therein or remaining in the dye developer layers.

In the embodiment illustrated in the FIGURE image receiving layer 40 and reflecting layer 38 against which the image is viewed are shown as layers of the film unit 10. While this is a particularly useful and preferred embodiment, image formation can be accomplished in a separate image receiving element comprising a transparent or opaque (e.g., baryta) support and an image receiving layer. The image receiving element may be brought into superposed relation with a photosensitive element comprising layers 12 through 38, either before or after photoexposure thereof. Polymeric layer 12 can be rendered opaque and development can be initiated by contact with an aqueous alkaline processing composition. The image receiving element can be left intact for viewing through the transparent support thereof, a reflection print against reflective layer 38. Alternatively, the image receiving element can be separated for a viewing of a transparency or reflection print, respectively in the case of a transparent or opaque image receiving element support.

According to another embodiment, transparent polymeric layer 12 can, if desired, be positioned between transparent support 14 and polymeric acid layer 16. It will be appreciated, however, that owing to the amount of time required for alkali to permeate the several layers of the film unit so as to permit conversion of the transparent layer 12 to an opaque layer, the positioning shown in the FIGURE is preferred.

A quaternary nitrogen-containing polymer suitable for use in layer 12 is disclosed and claimed in U.S. Pat. No. 4,452,878.

It should be noted here that other opacification systems may be used in layer 12. Further, it should also be recognized that photoexposure and processing of the film unit can be carried out in the dark in which case layer 12 is not required.

The invention will now be described further in detail with respect to specific preferred embodiments by way of examples, it being understood that these are illustrative only and the invention is not intended to be limited to the materials, conditions, process parameters, etc., which are recited therein.

EXAMPLE I

A mixture of 1-(4-acetyloximephenyl)-5-mercaptotetrazole (2.47 g, 0.0105 mole) and sodium bicarbonate (0.93 g, 0.011 mole) in 30 ml of water was stirred until a clear solution was obtained. The solution was cooled in an ice bath and 2.78 g (0.01 mole) of N-phenethyl-α-picolinium bromide was added thereto in portions with stirring. The resulting crystalline solid was collected by filtration, washed well with cold distilled water and dried under vacuum to give 4.85 g (89% yield) of a yellow solid, compound I.

$C_{23}H_{24}N_6OS$ requires 63.87% C; 5.59% H; 19.43% N; and 7.41% S. Elemental analysis found 63.87% C; 5.70% H, 19.44% N and 7.61% S.

EXAMPLE II

A solution of 1-(4-hydroxyphenyl)-5-mercaptotetrazole (9.7 g, 0.05 mole) in aqueous sodium bicarbonate (4.5 g in 200 ml of water) was formed. The solution was filtered and to the filtrate there was added an aqueous solution of N-phenthyl-α-picolinium bromide (14.0 g in 100 ml of water) dropwise with stirring. The reaction mixture was stirred for 30 minutes. The resulting white solid was collected by filtration, washed well with distilled water and dried under vacuum to give 19.16 g (97.8% yield) of compound II.

$C_{21}H_{21}N_5OS$ requires 64.43% C; 5.41% H; 17.89% N; and 8.19% S. Elemental analysis found 64.33% C; 5.43% H; 17.84% N; and 8.34% S.

EXAMPLE III

To a solution of 1-(4-sulfonamidophenyl)-5-mercaptotetrazole (25.7 g, 0.1 mole) in aqueous sodium hydroxide (8 g of 50% solution diluted with 400 ml of water) there were added solid $CO_2$ followed by sodium bicarbonate (2 g) to assure pH of about 8. The solution was filtered and to the filtrate there was added a solution of N-phenethyl-α-picolinium bromide (27.8 g, 0.1 mole) in 200 ml of water with stirring. The solution was cooled in an ice bath and the resulting white precipitate was collected by filtration, washed three times with 200 ml volumes of water and then dried with a water aspirator followed by vacuum, first at ambient temperature overnight and then at 50° C. to give 40.89 g (89.7% yield) of compound III.

$C_{21}H_{22}N_6O_2S_2$ requires 55.49% C; 4.88% H; 18.49% N; and 14.11% S. Elemental analysis found 55.41% C; 4.90% H; 18.49% N; and 14.30% S.

EXAMPLE IV

A solution was formed by stirring 1-(4-hydroxyphenyl)-5-mercaptotetrazole (9.7 g, 0.05 mole) with aqueous sodium hydroxide (3.5 g of a 50% solution diluted to 35 ml) and aqueous sodium bicarbonate (2 g in 40 ml of water). The solution was filtered and to the filtrate there was added, with stirring, N-phenethyl-α-pyridinium bromide (13.3 g, 0.05 mole). The reaction mixture was stirred for 15 minutes. The resulting while solid was collected by filtration, washed well with distilled water and dried under vacuum to give 8.95 g (47.4% yield) of compound IV.

EXAMPLE V

As a control a film unit was prepared as follows: the negative element comprised an opaque subcoated polyethylene terephthalate film base on which the following layers were coated in succession:

1. as a polymeric acid layer approximately 9 parts of a ½ butyl ester of polyethylene/maleic anhydride copolymer and 1 part of polyvinyl butyral coated at a coverage of about 26,460 mgs./m.$^2$;

2. a timing layer comprising about 97% of a 60-29-6-4-0.4 pentapolymer of butylacrylate, diacetone acrylamide, methacrylic acid, styrene and acrylic acid and about 3% polyvinylalcohol coated at a coverage of about 3000 mgs./m.$^2$;

3. a cyan dye developer layer comprising about 511 mgs./m.$^2$ of a cyan dye developer represented by the formula

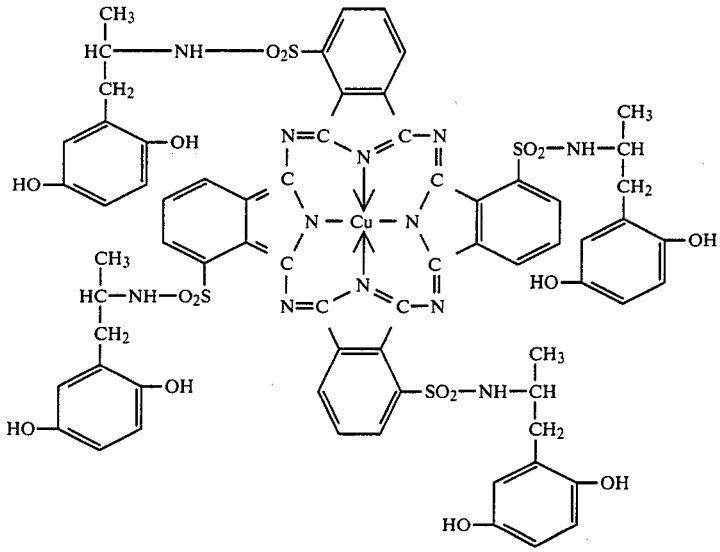

about 70 mgs./m.$^2$ of 4' methyl phenyl hydroquinone and about 317 mgs./m.$^2$ of gelatin;

4. a red-sensitive silver iodobromide emulsion layer comprising about 1378 mgs./m.$^2$ of silver and about 827 mgs./m.$^2$ of gelatin;

5. an interlayer comprising about 2090 mgs./m.$^2$ of the pentapolymer described in layer 2, about 110 mgs./m.$^2$ of polyacrylamide and about 44 mgs./m.$^2$ of succinaldehyde;

6. a magenta dye developer layer comprising about 460 mgs./m.$^2$ of a magenta dye developer represented by the formula

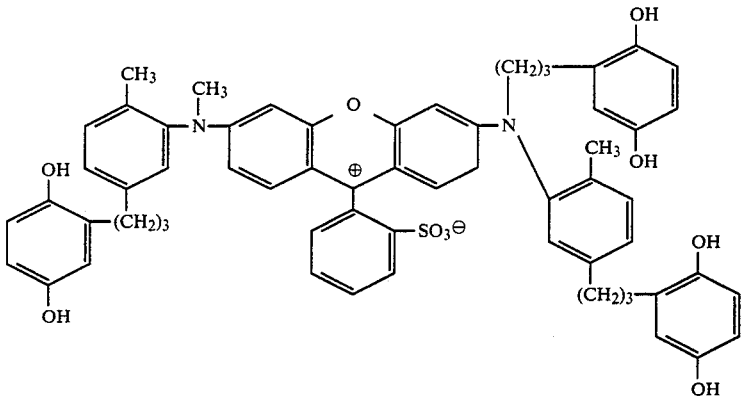

and about 210 mgs./m.$^2$ of gelatin;

7. a green-sensitive silver iodobromide emulsion layer comprising about 723 mgs./m.$^2$ of silver and about 318 mgs./m.$^2$ of gelatin;

8. an interlayer comprising about 1881 mgs./m.$^2$ of the pentapolymer described in layer 2 and about 99 mgs./m.$^2$ of polyacrylamide;

9. a yellow dye developer layer comprising about 689 mgs./m.$^2$ of a yellow dye developer represented by the formula

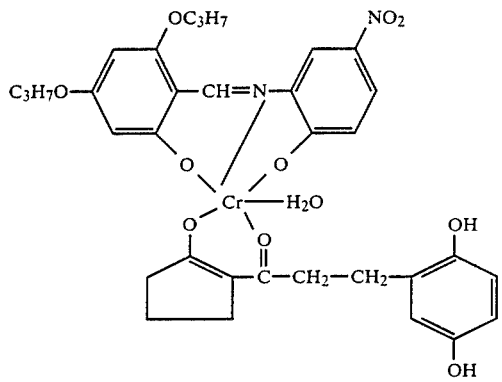

and about 265 mgs./m.$^2$ of gelatin;

10. a blue-sensitive silver iodobromide emulsion layer comprising about 764 mgs./m.$^2$ of silver, about 499 mgs./m.$^2$ of gelatin and about 265 mgs./m.$^2$ of 4'-methyl phenyl hydroquinone; and 11. a topcoat layer of 400 mgs./m.$^2$ of gelatin.

The image receiving element comprised a transparent subcoated polyethylene terephthalate film base upon which there were coated the following layers 1. an image receiving layer coated at a coverage of about 3229 mgs./m.$^2$ of a graft copolymer comprised of 4-vinylpyridine (4VP) and vinyl benzyl trimethylammonium chloride (TMQ) grafted onto hydroxyethyl cellulose (HEC) at a ratio HEC/4VP/TMQ of 2.2/2.2/1; and about 54 mgs./m.$^2$ of 1,4-butanediol diglycidyl ether; and 2. a topcoat layer comprising about 1076 mgs./m.$^2$ of unhardened gelatin.

The film unit was processed with a processing composition made up as follows:

| | WEIGHT PERCENT |
|---|---|
| Titanium dioxide | 50.4 |
| Potassium hydroxide | 4.41 |
| Colloidal silica | 0.24 |
| Oximated Polydiacetone acrylamide | 0.70 |
| 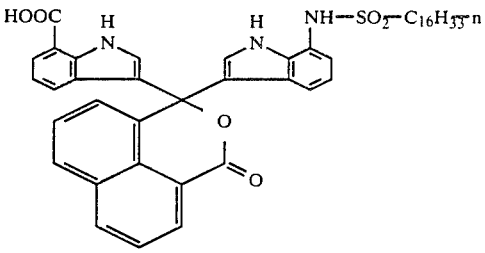 | 0.45 |
| 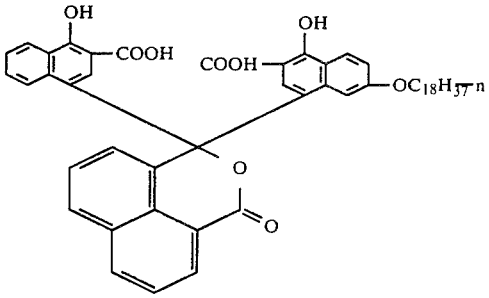 | 1.67 |

-continued

| | WEIGHT PERCENT |
|---|---|
| Water | 42.13 |

The negative was exposed to a test target (2 mcs) and processed by passing it, together with the image receiving element through a pair of rollers set at a gap spacing of 0.0030".

Three additional film units (A–C) were made. These were identical with the control with the exception that the photosensitive element further included a topcoat layer comprised of about 215 mgs./m.$^2$ of gelatin and 215 mgs./m.$^2$ of compounds I–III respectively. The film units were processed in the identical manner.

| | $D_{max}$ | | | $D_{min}$ | | |
|---|---|---|---|---|---|---|
| FILM UNIT | R | G | B | R | G | B |
| CONTROL | 1.75 | 1.98 | 2.21 | 0.28 | 0.30 | 0.47 |
| A | 1.69 | 2.09 | 2.26 | 0.22 | 0.21 | 0.36 |
| B | 1.74 | 1.99 | 2.36 | 0.22 | 0.21 | 0.39 |
| C | 1.70 | 1.92 | 2.33 | 0.20 | 0.20 | 0.36 |

It can be seen that the film units according to the invention exhibited lower red, green and blue minimum densities thus indicating speed enhancement and development acceleration. Further, the lower blue minimum densities indicate enhanced control of the yellow dye.

Although the invention has been described with respect to specific preferred embodiments it is not intended to be limited thereto but rather those skilled in the art will recognize that variations and modifications may be made therein which are within the spirit of the invention and the scope of the appended claims.

What is claimed is:

1. A photographic element comprising a support and at least one layer thereon containing a silver halide emulsion having associated therewith a compound represented by the formula

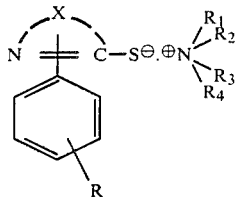

wherein X represents the nonmetallic atoms necessary to form a nucleus which completes a five- or six member heterocyclic moiety; R is either a group which has a pKa of from about 7 to about 14 which is ionizable to an anion and wherein the silver salt of the mercaptan resulting from dissociation of said compound is more soluble in the range within which R is ionized to an anion than it is below that pH range, or a precursor thereof; and $R_1$, $R_2$, $R_3$ and $R_4$ are each independently alkyl, or $R_1$ is $-(CH_2)_n-R_5$ and $R_2$, $R_3$ and $R_4$, together with the nitrogen atom, form a six member heterocyclic ring; $R_5$ is hydrogen, phenyl or substituted phenyl; and n is an integer of from 1 to 6.

2. The photographic element defined in claim 1 wherein X represents the nonmetallic atoms necessary to complete a tetrazole moiety.

3. The photographic element defined in claim 2 wherein $R_1$ is $-(CH_2)_n-R_5$ and $R_2$, $R_3$ and $R_4$, together with the nitrogen atom form a six member heterocyclic ring.

4. The photographic element defined in claim 3 wherein $R_1$ is

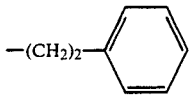

and $R_2$, $R_3$ and $R_4$, together with the nitrogen atom, form a pyridine ring having a methyl substituent in the ortho position.

5. The photographic element defined in claim 4 wherein R is —OH, $-SO_2-NH_2$ or

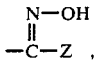

wherein Z is hydrogen, alkyl having from 1 to 10 carbon atoms, aralkyl or phenyl.

6. A photographic product for use in forming a multicolor diffusion transfer image comprising a photosensitive element comprising a support carrying a blue-sensitive silver halide emulsion having a yellow image dye-providing material associated therewith, a green-sensitive silver halide emulsion having a magenta image dye-providing material associated therewith and a red-sensitive silver halide emulsion having a cyan image dye-providing material associated therewith, a second sheet-like element positioned in superposed or superposable relationship with said photosensitive element, an image receiving layer positioned in one of said elements, a rupturable container releasably holding an aqueous alkaline processing composition adapted, when distributed between a pair of predetermined layers carried by said photosensitive element and said second element, to develop said silver halide emulsions and provide a multicolor diffusion transfer image on said image receiving layer, at least one of said photosensitive and second elements including a compound represented by the formula

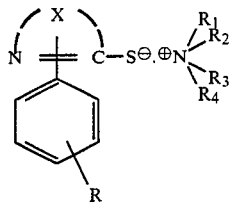

wherein X represents the nonmetallic atoms necessary to form a nucleus which completes a five or six member heterocyclic moiety; R is either a group which has a pKa of from about 7 to about 14 which is ionizable to an anion and wherein the silver salt of the mercaptan resulting from dissociation of said compound is more soluble in the range within which R is ionized to an anion than it is below that pH range, or a precursor thereof; and $R_1$, $R_2$, $R_3$ and $R_4$ are each independently alkyl, or $R_1$ is $-(CH_2)_n-R_5$ and $R_2$, $R_3$ and $R_4$, together with the nitrogen atom, form a six member heterocyclic ring; $R_5$ is hydrogen, phenyl or substituted phenyl; and n is an integer of from 1 to 6.

7. The photographic product as defined in claim 6 wherein said second element includes said image receiving layer carried by a transparent support and said processing composition includes titanium dioxide.

8. The photographic product defined in claim 6 wherein X represents the nonmetallic atoms necessary to complete a tetrazole moiety.

9. The photographic product as defined in claim 8 wherein $R_2$ is $-(CH_2)_n-R_5$ and $R_2$, $R_3$ and $R_4$ together with the nitrogen form a six member heterocyclic ring.

10. The photographic product defined in claim 9 wherein $R_1$ is

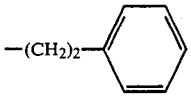

and $R_2$, $R_3$ and $R_4$, together with the nitrogen atom, form a pyridine ring having a methyl substituent in the ortho position.

11. The photographic product defined in claim 10 wherein R is —OH, $-SO_2NH_2$ or

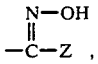

wherein Z is hydrogen, alkyl having from 1 to 10 carbon atoms, aralkyl or phenyl.

12. A diffusion transfer film unit comprising:

(a) a photosensitive element comprising a support, a silver halide emulsion in a layer carried by said support and an image dye-providing material in a layer carried by said support on the same side thereof as said silver halide emulsion;

(b) a second sheet-like element adapted to be superposed on said photosensitive element during or after photoexposure;

(c) an image receiving layer positioned in one of said photosensitive or second sheet-like element;

(d) a rupturable container releasably holding an aqueous alkaline processing composition and so positioned as to be adapted to distribute said processing composition between predetermined layers of said elements; and (e) present in a least one of said photosensitive and second sheet-like elements a compound represented by the formula

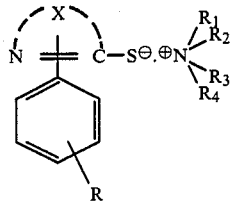

wherein X represents the nonmetallic atoms necessary to form a nucleus which completes a five or six member heterocyclic moiety; R is either a group which has a pKa of from about 7 to about 14 which is ionizable to an anion and wherein the silver salt of the mercaptan resulting from dissociation of said compound is more soluble in the range within which R is ionized to an anion than it is below that pH range, or a precursor thereof; and $R_1$, $R_2$, $R_3$ and $R_4$ are each independently alkyl, or $R_1$ is $-(CH_2)_n-R_5$ and $R_2$, $R_3$ and $R_4$, together with the nitrogen atom, form a six member heterocyclic ring; $R_5$ is hydrogen, phenyl or substituted phenyl; and n is an integer of from 1 to 6.

13. The film unit defined in claim 12 wherein $R_1$ is

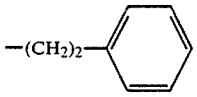

and $R_2$, $R_3$ and $R_4$, together with the nitrogen atom, form a pyridine ring having a methyl substituent in the ortho position.

14. The film unit defined in claim 13 wherein R is —OH, $-SO_2NH_2$ or

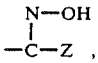

wherein Z is hydrogen, alkyl having from 1 to 10 carbon atoms, aralkyl or phenyl.

15. A diffusion transfer photographic process comprising exposing a film unit comprising a photosensitive element and a second element, said photosensitive element comprising a support carrying at least one silver halide emulsion having an image dye-providing material associated therewith, applying an aqueous alkaline processing composition to said exposed photosensitive element to the effect photosensitive element to the effect development and to form an imagewise distribution of said image dye-providing material as a function of development and transferring at least a portion of said imagewise distribution of image dye-providng material to an image receiving layer in superposed or superposable relationship to thereby provide a diffusion transfer image, at least one of said photosensitive and second elements including a compound represented by the formula

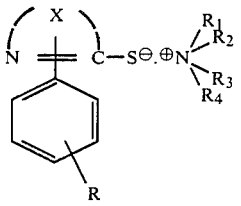

wherein X represents the nonmetallic atoms necessary to form a nucleus which completes a five or six member heterocyclic moiety; R is either a group which has a pKa of from about 7 to about 14 which is ionizable to an anion and wherein the silver salt of the mercaptan resulting from dissociation of said compound is more soluble in the range within which R is ionized to an anion than it is below that pH range, or a precursor thereof; and $R_1$, $R_2$, $R_3$ and $R_4$ are each independently alkyl, or $R_1$ is $-(CH_2)_n-R_5$ and $R_2$, $R_3$ and $R_4$, together with the nitrogen atom, form a six member heterocyclic ring; $R_5$ is hydrogen, phenyl or substituted phenyl; and n is an integer of from 1 to 6.

16. The process defined in claim 15 wherein the photosensitive element comprises a support carrying a blue-sensitive silver halide emulsion layer having a yellow image dye-providing material associated therewith, a green-sensitive silver halide emulsion layer having a magenta image dye-providing material associated therewith and a red-sensitive silver halide emulsion layer having a cyan image dye-providing material associated therewith.

17. The process defined in claim 16 wherein X represents the nonmetallic atoms which complete a tetrazole moiety.

18. The process as defined in claim 17 wherein $R_1$ is $-(CH_2)_n-R_5$ and $R_2$, $R_3$ and $R_4$, together with the nitrogen atom, form a six member heterocyclic ring.

19. The process as defined in claim 18 wherein $R_1$ is

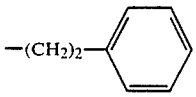

and $R_2$, $R_3$ and $R_4$, together with the nitrogen atom, form a pyridine ring having a methyl substituent in the ortho position.

20. The photographic process defined in claim 19 wherein R is —OH, $-SO_2NH_2$ or

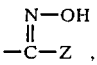

wherein Z is hydrogen, alkyl having from 1 to 10 carbon atoms, aralkyl or phenyl.

* * * * *